US005941192A

United States Patent [19]

Tavone et al.

[11] Patent Number: 5,941,192

[45] Date of Patent: Aug. 24, 1999

[54] SHIP BORNE LIFTS FOR TENDERS AND METHODS FOR USING SAME

[75] Inventors: John H. Tavone, 3608 Bridge Rd., Cooper City, Fla. 33026; Donald Dones, Ft. Lauderdale, Fla.

[73] Assignee: John H. Tavone, Cooper City, Fla.

[21] Appl. No.: 08/899,333

[22] Filed: Jul. 23, 1997

Related U.S. Application Data

[63] Continuation-in-part of application No. 08/692,692, Aug. 6, 1996, and a continuation of application No. 08/784,380, Jan. 17, 1997.

[51] Int. Cl.[6] ..... B65D 88/78

[52] U.S. Cl. ..... 114/256; 414/137.7

[58] Field of Search ..... 114/258, 259, 114/260; 414/137.7, 137.8, 137.9, 139.5

[56] References Cited

U.S. PATENT DOCUMENTS 3,437,066 4/1969 Schwendtner ..... 114/260

3,508,510 4/1970 Frankel ..... 114/260

*Primary Examiner*—Jesus D. Sotelo

*Attorney, Agent, or Firm*—Millen, White, Zelano, & Branigan, P.C.

[57] ABSTRACT

A ship has a stern with a facility for docking and undocking tenders. Preferably, the facility is a rearwardly opening bay in the stern of the ship which has a hoist therein. Alternatively, the hoist projects rearwardly from the stern. In practicing the invention, tenders shuttle between the ship and shore while docking and undocking from the ship while the ship is underway. Since the ship is underway, a relatively flat sea is created in the wake of the ship which allows the tenders approaching the stern of the ship to dock and undock while floating in either the flat sea or in a calm pond within the bay.

23 Claims, 12 Drawing Sheets

SHIP BORNE LIFTS FOR TENDERS AND METHODS FOR USING SAME

CROSS-REFERENCE TO RELATED APPLICATION

This application is a continuation-in-part of U.S. patent application Ser. No. 08/692,692, filed Aug. 6, 1996, and a continuation of U.S. patent application Ser. No. 08/784,380, filed Jan. 17, 1997, both of which are incorporated by reference herein.

FIELD OF THE INVENTION

The present invention relates to ship borne lifts for tenders and methods of using same, more particularly, the present invention relates to ship borne lifts for tenders wherein the tenders are used as shuttles.

BACKGROUND OF THE INVENTION

There are numerous situations in which ships are located offshore and must shuttle passengers and crew between the ship and shore facilities. For example, cruise ships frequently stop at remote locations which may not have adequate facilities for docking the cruise ships. Arrangements must then be made for transferring passengers to and from tenders which shuttle passengers back and forth between the location and ship. If the sea around the ship is at all rough, then the tenders can move substantially and abruptly with respect to the ship and subject passengers to the risk of serious injury.

When ships are located off shore for extended periods of time and conduct activities which may not be available on shore but which people wish to engage in on the ship, it is necessary to provide an arrangement wherein a number of tenders can transport people to and from the ship, from which tenders relatively large numbers of passengers can safely embark and disembark. In such situations, it is necessary that cycle be as rapid as possible, so that if there is a que of tenders, the wait is not excessive, since waiting in a rocking boat is conducive to seasickness and slipping and falling.

SUMMARY OF THE INVENTION

In view of the aforementioned considerations, it is a feature of the present invention to provide a new and improved arrangement for docking tenders with ships.

In view of this feature and other features, the present invention is directed to a ship having a stern which has facilities for receiving and unloading passengers or cargo. When the ship is underway at a slow speed or when the ship is anchored with its bow windward and its stern leeward, a relatively calm sea occurs to the stern of the ship. A hoist assembly, either within the ship or attached directly to the stern of the ship, detachably connects with tenders to lift the tenders until they no longer float with respect to the ship, allowing the tender to be loaded and unloaded while stationary with respect to the ship.

In accordance with a first embodiment, the hoist is mounted on a carriage which is movable in a direction toward and away from the stern of the ship to move the tender being docked, into a bay in the stern of the ship, once the tender has been lifted by the hoist. A platform adjacent to the hoist for loading and unloading the tender latches with the tender when the tender is positioned adjacent thereto to prevent relative motion between the ship and tender.

In a more specific aspect of the first embodiment, the hoist is comprised of netting suspended by straps, which netting is looped beneath the hull of the tender to lift the tender from the water by winding the straps on pairs of opposed windlasses.

In a further aspect of the first embodiment, the carriage assembly is comprised of a pair of laterally spaced cars to which the windlasses are attached, which cars are in twin mounted on a pair of laterally spaced rails. The cars are linked together to move simultaneously on the rails in the direction of axial extent of the rails.

In accordance with a second embodiment of the invention, the tender is hoisted by a cradle which is stabilized with respect to the ship. In this second embodiment, the cradle is not advanced longitudinally into or longitudinally toward the ship after the tender has been hoisted.

Further in accordance with the second embodiment, the cradle is suspended from a frame projecting from the stern of a ship, which may, for example, be a relatively small vessel.

Still further with respect to the second embodiment, the hoist is positioned within a bay in the stern of the ship, the hoist being suspended from a supporting structure which is part of side walls of the bay without laterally spaced rails, the hoist assembly being straps or cables on windlasses.

In accordance with one aspect of the second embodiment, the cradle is hoisted by cables wound on windlasses and in accordance with another aspect the cradle is hoisted by hydraulic cylinders having extending piston roads which are attached to the cradle.

In the second embodiment passengers disembark from and board the ship through a gangway, preferably in the form of an enclosed, telescoping passageway.

A method of practicing the invention includes returning ship passengers from an off-shore ship having a bow and a stern by carrying the passengers from the ship to shore on a shuttle craft; wherein the shuttle craft was previously docked with the ship according to a shuttling method of shuttling passengers between the ship and shore, and wherein the ship is cruised at a relatively slow speed creating a relatively flat sea to the stern of the ship with the shuttle craft approaching the stern of the ship through the relatively flat sea. According to the shuttling method, the shuttle craft is lifted by lifting a cradle to suspend the shuttle craft from the ship adjacent the stern thereof so that the shuttle craft no longer floats when docked with the ship and is stable with respect to the ship when docked therewith. The passengers board the shuttle craft while the shuttle craft is suspended from and stable with respect to the ship for returning to shore upon lowering the shuttle craft back into the sea.

In practicing a more specific aspect of the method, the cradle is disposed within a bay in the stern of the ship, which bay is flooded to float at least one tender therein before the tender is lifted and after the tender is lowered for a return trip.

BRIEF DESCRIPTION OF THE DRAWINGS

Various other features and attendant advantages of the present invention will be more fully appreciated as the same becomes better understood when considered in conjunction with the accompanying drawings, which like reference characters designate the same or similar parts through several views, and wherein.

DETAILED DESCRIPTION

I) General Description

Figure 1:
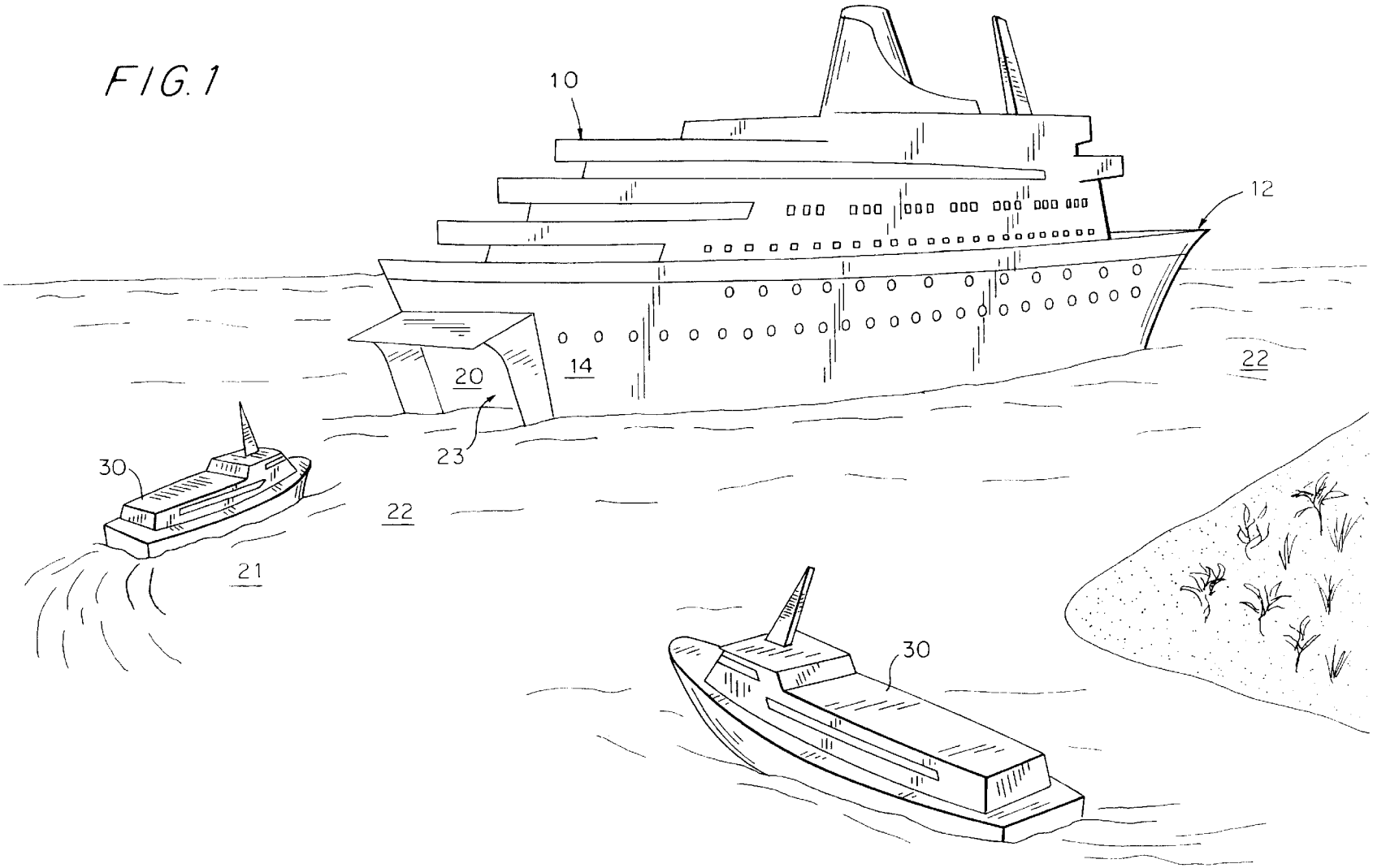
FIG. 1 is a side view showing tenders, comprising a fleet of shuttle craft, moving toward a bay formed in the stern of a relatively large ship.

Referring now to FIG. 1, there is shown a ship 10 having bow 12 and a stern 14. The stern 14 of the ship 10 has a bay 20 therein which opens to the sea 22 at the stern. The sea 22 is relatively calm because, while this invention is being practiced, the stern 14 is in the lea of the ship 10. In accordance with a first embodiment of the invention (FIGS. 3–8), the surface 21 of the sea 22 is preferably just below the floor 23 of the bay 20 and, in accordance with a second embodiment of the invention (FIGS. 9–13), the surface of the sea is higher than the floor of the bay so that the bay floods. Disposed within the bay 20 or projecting from the stern 14 of the ship 10 is a hoist assembly which is one of the hoist assemblies 28 (or 100) of FIGS. 3–13 for hoisting tenders 30 above the level of the floor 23 of the bay in order to discharge and load passengers. The hoist assembly and area at the stern 14 of the ship 10 provide a facility for docking and undocking tenders 30.

In order to stabilize the ship 10 for activities occurring thereon, it is preferable that the ship be underway continuously at a relatively slow speed of, for example, about 4 knots when cruising off shore at a distance of, for example, at least 3 miles. The tenders 30 forming a fleet of shuttle craft therefore dock with the ship 10 while the ship is underway. The momentum of the moving ship 10 smooths and flattens the surface 21 of the sea 22 so that relative motion due to rolling, pitching and yawing between the tender 30 and the moving ship is minimized.

Occasionally, it may be feasible to anchor the ship 10. When anchored at its bow 12, the ship usually swings about its anchor pointing its bow into the wind so as to keep the stern 14 in the lea of the ship which reduces waves adjacent the bay 20 and hoist 28.

Figure 2:
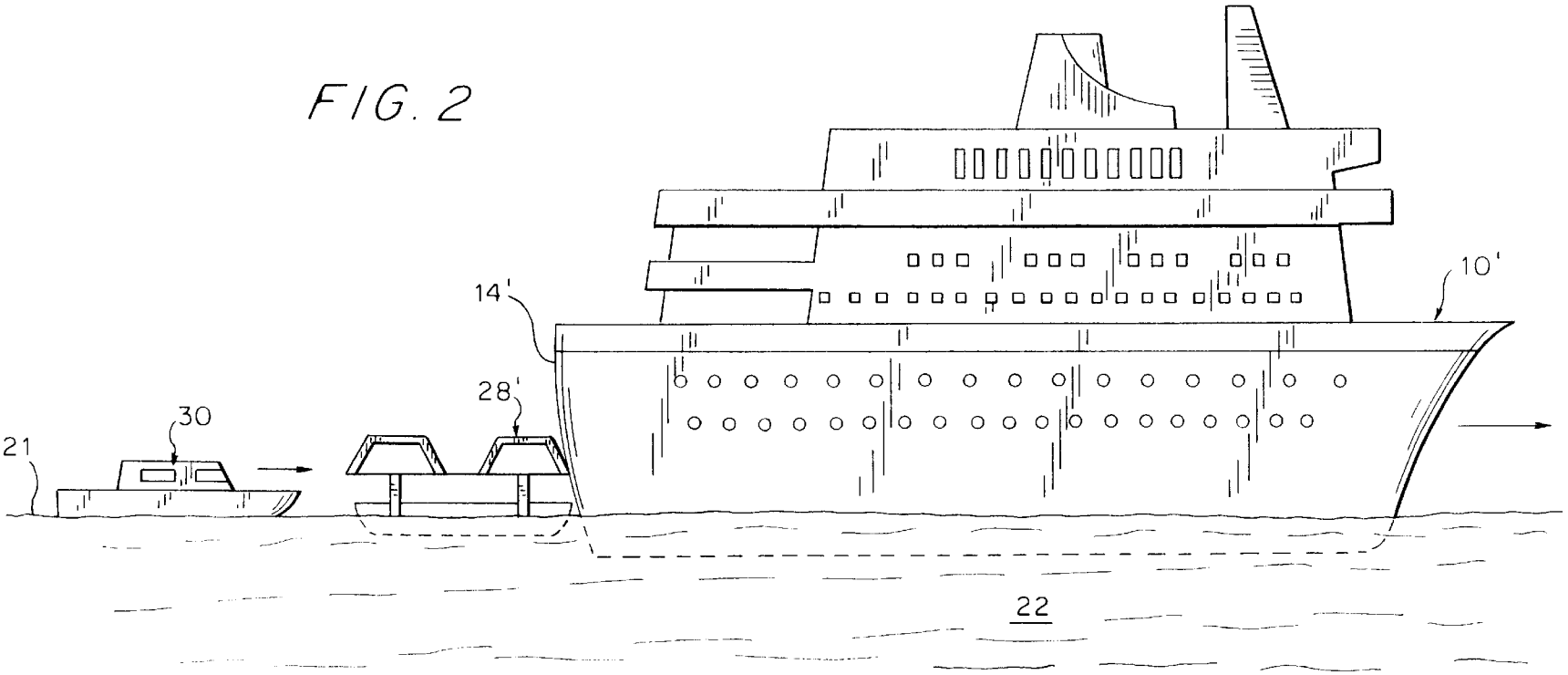
FIG. 2 is a side view showing a hoist assembly for docking and undocking tenders attached to the stern of a relatively small vessel.
Figure 3:
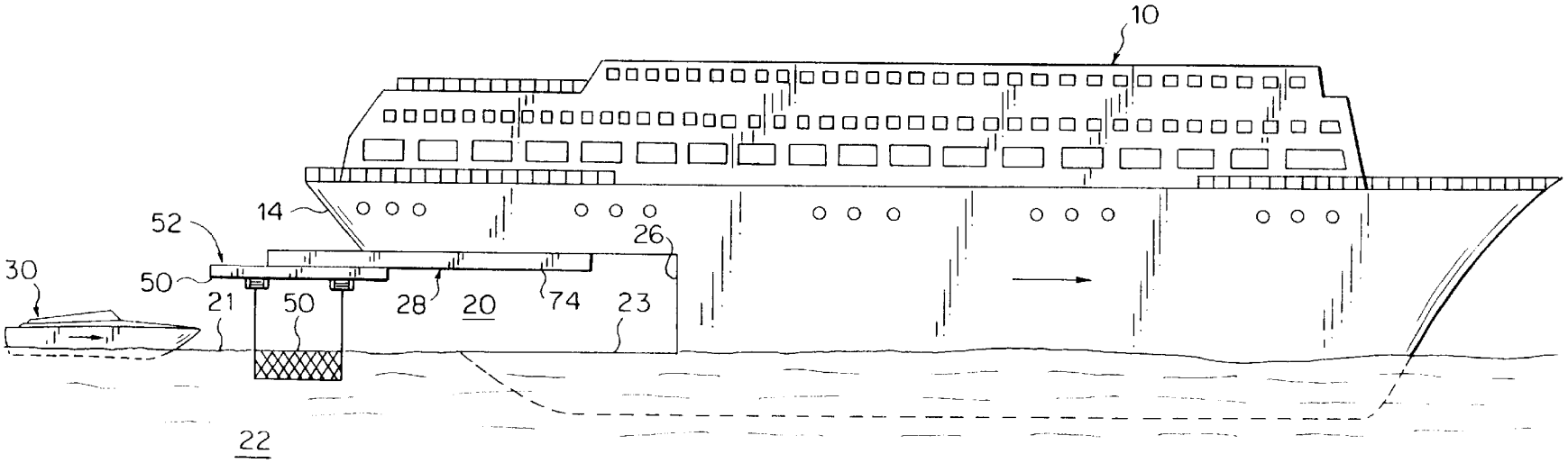
FIG. 3 is a side view of a first detailed embodiment of the invention showing a tender spaced from and approaching a bay formed in the stern of the ship of FIG. 1.

Referring now to FIG. 2 there is shown a relatively small vessel 10' with a rearwardly projecting hoist assembly 28' affixed to the stern 14' of the vessel. In the embodiment of FIG. 2, the hoist assembly 28' is preferably retrofitted to the stern 14' of the ship 10'.

II) Details of a First Embodiment (FIGS. 3–8)

Referring now to FIGS. 3–8, in a first embodiment of the invention, the tender 30 axially aligns itself with the bay 20 of the ship 10 in the relatively flat sea 22 proximate the stern 14 of the ship. Through the relatively flat sea 22 adjacent the stern 14 of the ship 10, the tender 30 advances into proximity with the bay 20.

Figure 4:
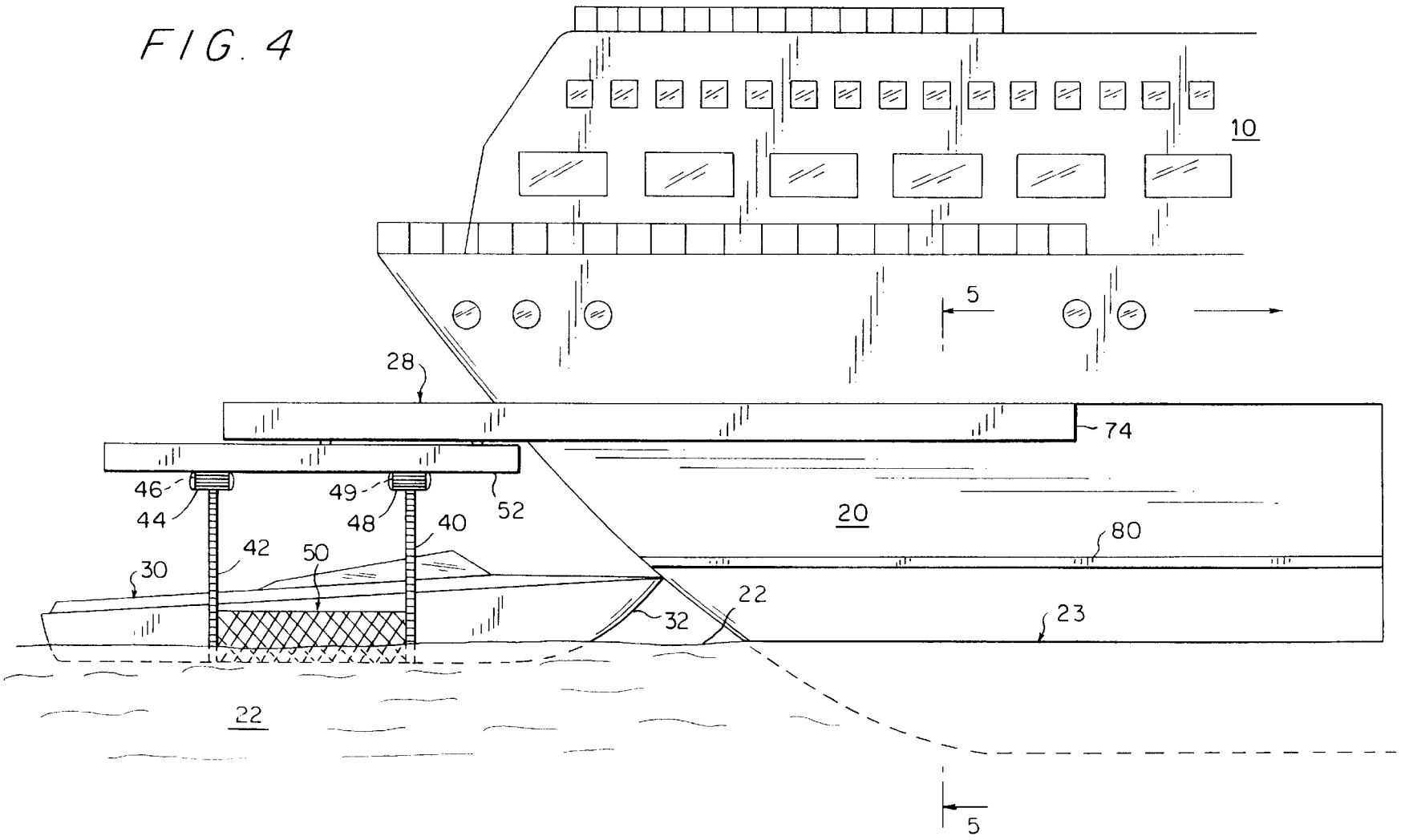
FIG. 4 is a side view similar to FIG. 3 but showing the tender engaged in a hoist assembly aligned with the bay of the ship.
Figure 5:
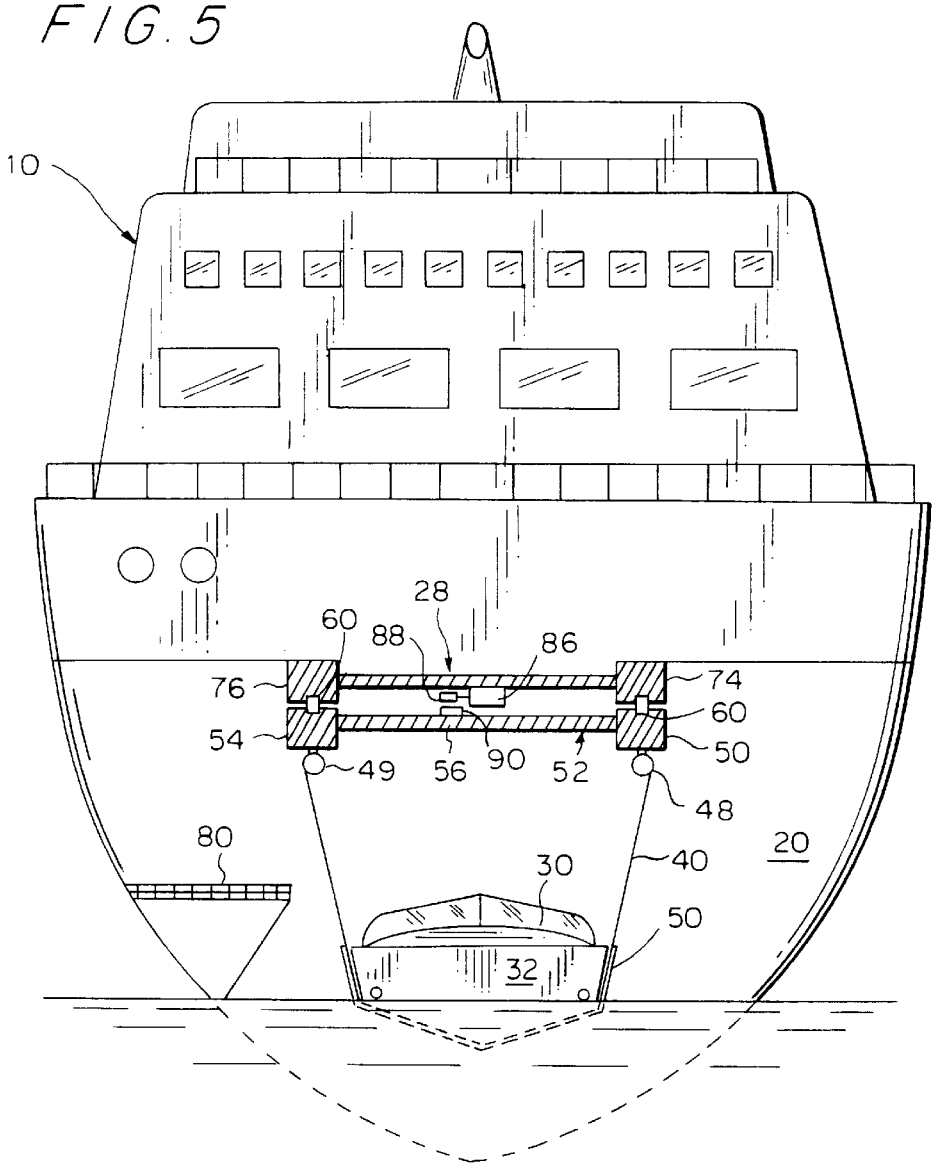
FIG. 5 is a front view of FIG. 4 taken along line 5—5.
Figure 6:
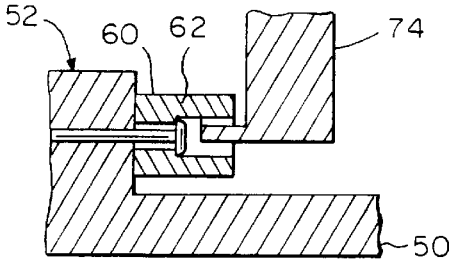
FIG. 6 is an end view showing how a carriage is mounted on an extender rail.

As is seen in FIGS. 4 and 5, the hoist assembly 28 is comprised of a pair of relatively heavy, laterally stiff straps or steel cables 40 and 42 which are mounted on pairs of windlasses 44 and 46 and 48 and 49, respectively. (Windlasses 46 is not shown because it is behind the windlass 48.) Between the straps 40 and 42 is a net 50 which is preferably a steel mesh with a Nylon® covering or coating. The drums 44 and 48 are mounted on a first car 51 of a carriage assembly 52 while the drums 46 and 49 are mounted on a second car 54 of the carriage assembly. The cars 51 and 54 each have a plurality of rollers 60 journaled thereon which have rims 62 (as is shown in FIG. 6) that have internal surfaces 64 which roll on ledges 66 of spaced, fixed rails 74 and 76.

Figure 7:
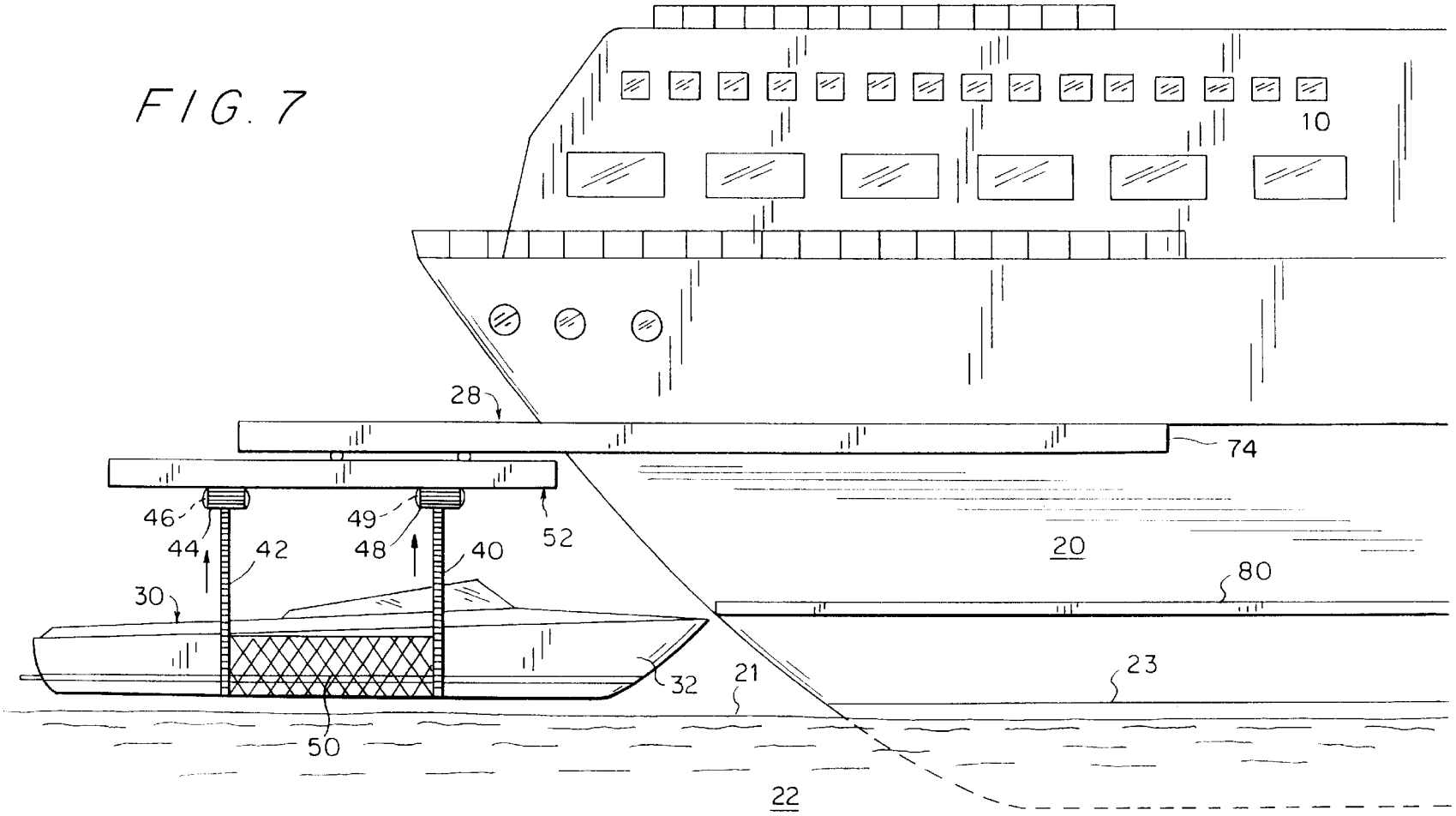
FIG. 7 is a side view showing the tender being lifted by the hoist shown in FIGS. 4 and 5.
Figure 8:
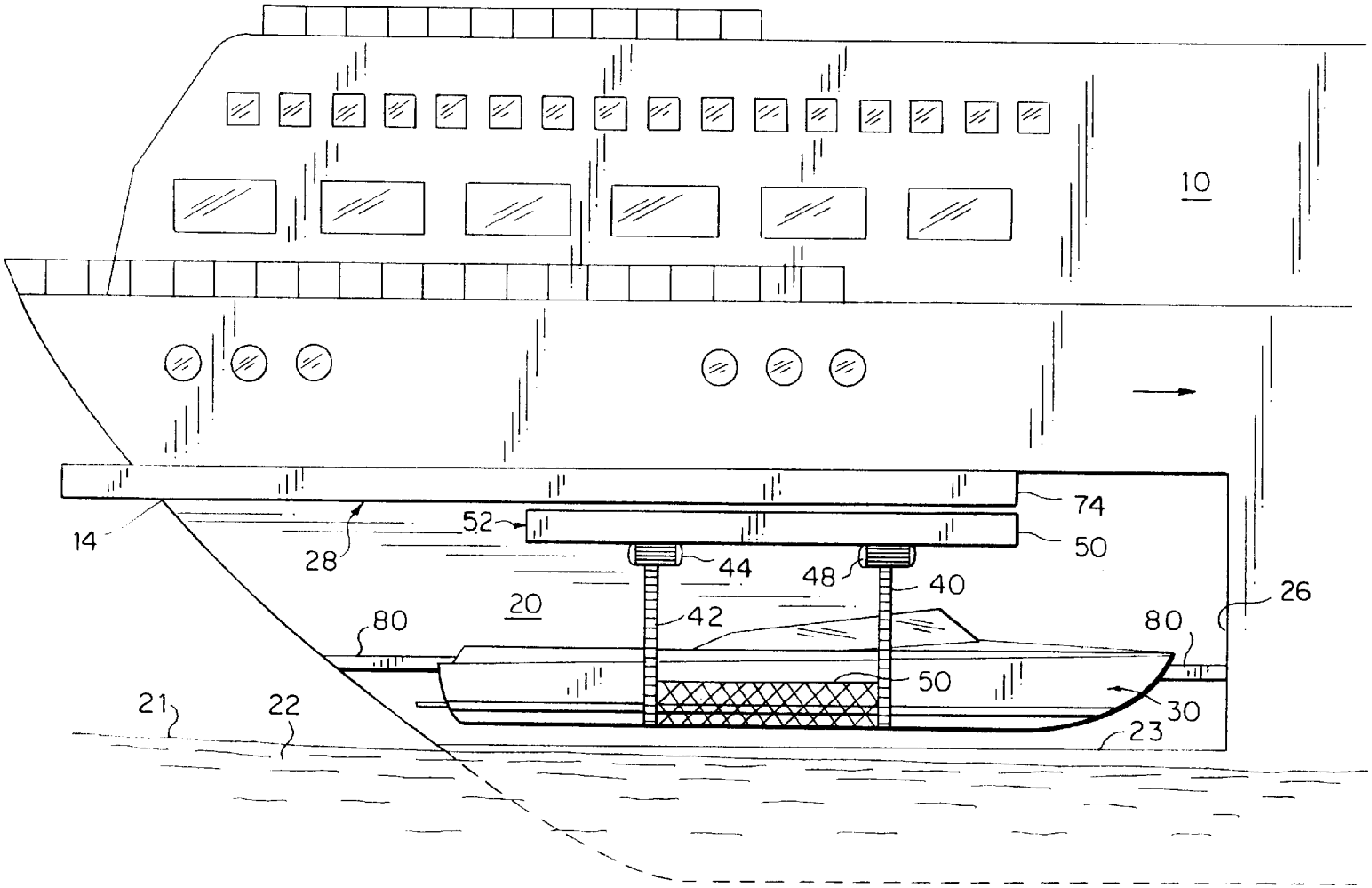
FIG. 8 is a side view similar to FIGS. 4, 5, and 6, but showing the lifted tender moved into the bay for discharging and loading passengers.

As is seen in FIG. 7, the tender 30 is lifted from its FIG. 4 position to a position in which a loading and unloading area 78 of the tender is at the same height as a deck 80 in the bay 20 of the ship 10. A conventional drive is used to move the carriage 52 and thus the tender 30 from the FIG. 7 position to the FIG. 8 position. As is seen in FIG. 5, the drive may be, for example, an electric motor 86 which rotates a pinion 88 that meshes with a toothed track 90 fixed with respect to the cars 51 and 54 of the carriage assembly 52. Rotation of the motor shaft moves the cars 50 and 54, and thus the carriage assembly 52, from the FIG. 7 position to the FIG. 8 position in which the tender 30 is substantially within the bay 20. The tender 30 is then latched to the platform 80 by a latching mechanism 81 which engages a lug 82 on the tender to keep the tender 30 from swinging relative to the platform.

When the tender 30 is completely within the bay 20, the passengers disembark from the tender onto the platform 80. After the tender 30 has discharged its passengers, passengers who wish to leave the ship can then board the tender. The process is then reversed and the tender 30 is moved by the carriage assembly 52 from the FIG. 8 position, back through the FIG. 7 position to the FIG. 4 position. Straps 40 and 42 of the hoist assembly 28 are then slacked and the tender 30 backs away from the stern 14 of the ship and proceeds to shore. The next tender 30 is then loaded into the ship 10 in the manner previously described.

The cycle of discharging passengers from, and loading passengers on, the tenders 30 continues for as long as necessary or desired. The arrangement allows passengers to load and disembark from the tenders 30 while within the comfort and protection of the ship's bay 20. By having the bay 20 at the stern 14 of the ship 10, relatively calm, lea water is available so that hoisting the tender 30 is accomplished with minimal jarring of passengers as the tender becomes suspended by the hoist assembly 28 of the ship 10.

III) Details of a Second Embodiment (FIGS. 9–12)

Referring now to FIGS. 9–12, there is shown a second embodiment of a hoist assembly, hoist assembly 100, wherein the hoist assembly includes a support frame 102, a cradle 104 and lift assemblies 106 comprised of windlasses 108 driven by motors 110 that are mounted on pedestals 112 (used with the arrangement of FIG. 2). The pedestals 112 project upwardly from an upper beam assembly 114 of the support frame 102. The upper beam assembly 114 includes a first longitudinal beam 116 and a second longitudinal beam 118, the longitudinal beams being joined by a lateral beam 120. The beam assembly 114 is supported by a column arrangement 122 comprising side front columns 124 and 126, central front columns 128 and 130 and pairs of opposed side columns 132, 134, 136 and 138 located on opposite sides of the support frame 102. The columns 124–138 project from an array of base beams 140–148. Between the columns 124, 126; 128, 130, 132, 134 and 136, 138 are slots 150, 152, and 154, respectively. The slots 150, 152 and 154 have downwardly opening, converging inlets 156, 158 and 160, respectively.

In accordance with a first species (FIG. 9) of the second embodiment of the hoist assembly 100, the support frame 102 is fixed to the stern of a relatively small vessel, such as the vessel 10' shown in FIG. 2 to provide the illustrated rearwardly projecting hoist arrangement 28' of FIG. 2. In accordance with a second species (FIGS. 10–12) of the second embodiment, the pedestals 112 are removed and the frame 102' is disposed within the bay 20.

The cradle 104 is comprised of top side beams 160 and 162 joined by a series of arcuate ribs 164. The arcuate ribs 164 are stiffened by longitudinal struts 166 which extend from the rear 168 of the cradle 104 to the front 170 of the cradle. At the front of the cradle 170, the side beams 160 and 162 converge so that the cradle has a shape corresponding to the shape of the tenders 30.

A front lifting strap 176 and a rear lifting strap 178 are connected by cables 180, which may be steel cables, with the windlasses 108. The front and rear lifting straps 176 and 178 are relatively stiff structures and each comprise front and rear strap elements 182 and 184 which diverge and are fixed at the tops thereof to cross members 186, the cross members 186 each having a cable 180 attached thereto. When the motors 110 rotate the windlasses 108 to take up the cables 180, the front and rear lifting straps 176 and 178, which are fixed to the cradle 104, lift the cradle from the position of FIG. 10 to the position of FIG. 11 so as to raise the tender 30 to a position where it is mechanically coupled or connected to the ship 10, rather than floating with respect to the ship. The tender 30 being hoisted does not have to be lifted completely from the water, but only high enough so that it no longer displaces its own weight and is supported totally in the cradle 104.

In order to prevent the tender 30 from swinging to any significant extent because it is suspended by the cables 180, an array of T-shaped lifting lugs 190 project from the upper beams 160 and 162 of the cradle 104. Each T-shaped lug 190 includes a shank 192 and a cross bar 194. The shanks 192 are slidably received in the slots 150, 152 and 154, while the cross bars 194 engage the outside surfaces of the frames 102 and 102'. In this way, the tender 30 is coupled or latched with the ship 10 as the tender is raised, so that, if the ship happens to roll, pitch or yaw slightly there is no relative motion between the tender and ship. Such motion may be disconcerting, if not dangerous, to passengers as they transfer between the tender 30 and ship 10.

In the second embodiment of the invention, a telescoping, gangway in the form of an enclosed passageway 200 is used to transfer passengers across an internal flat floor 202. After the tender 30 has been stabilized by lifting the cradle 104 from the FIG. 10 to the FIG. 11 position, the telescoping passageway 200 is extended from the ship 10 across the bow 201 of the tender 30 so the passengers disembark from tender 30 into the ship 10 or disembark from the ship to the tender by walking on the floor or platform 202 that extends through the passageway. After the transfer of passengers has been completed, the passageway 200 is retracted and the cradle 104 is lowered from its FIG. 11 position back to its FIG. 10 position which allows the tender 30 to float in the bay 20. The tender 30 then backs out of the bay 20 into the calm water 21 at the stern 14 of the ship 10 and returns to land.

Figure 9:
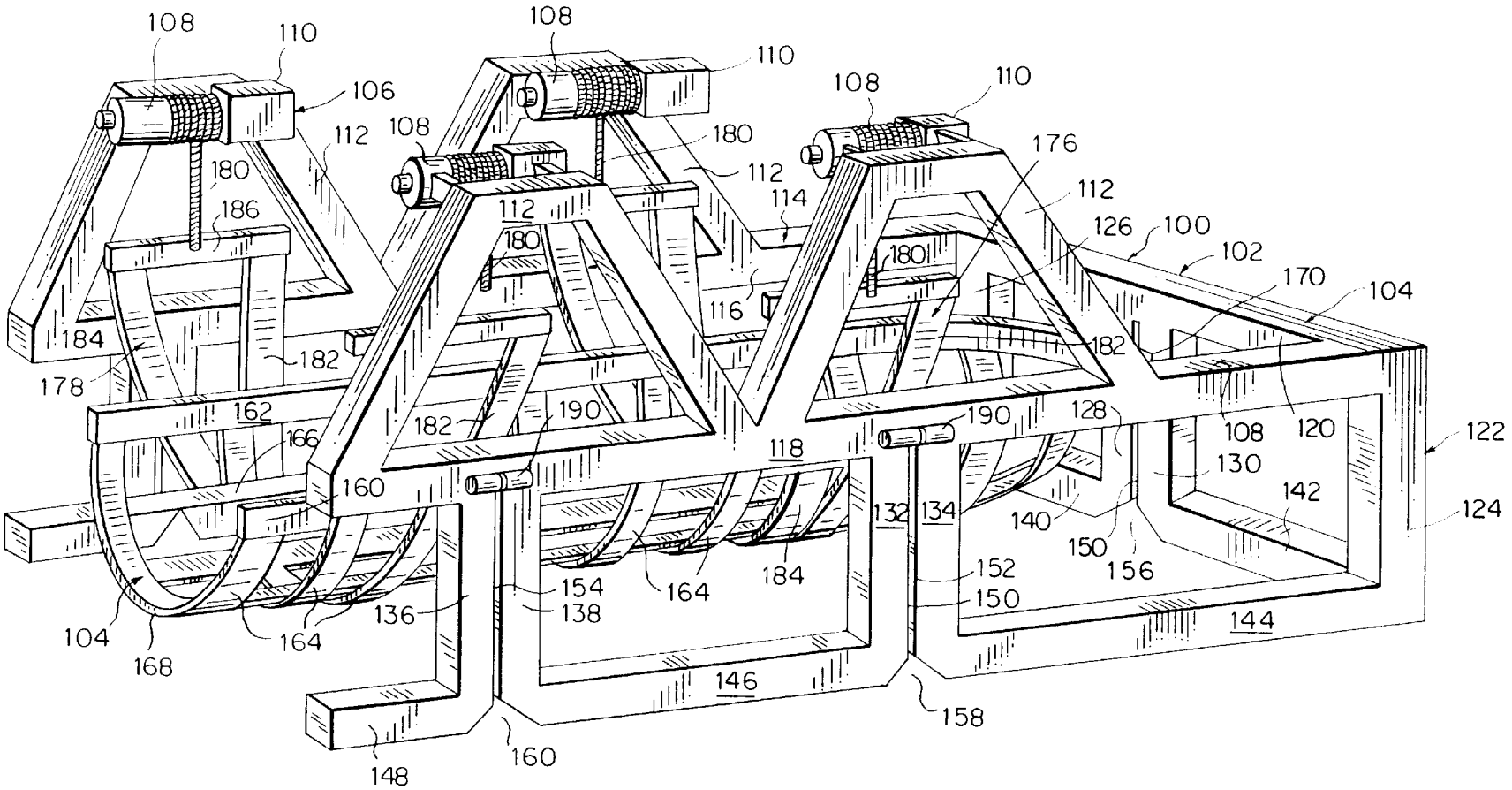
FIG. 9 is a perspective view of a hoist assembly in accordance with a first species of a second embodiment of the invention, which hoist assembly includes a frame which may be affixed to the stern of a ship (as in FIG. 2), wherein the frame supports a cradle for lifting a tender.
Figure 10:
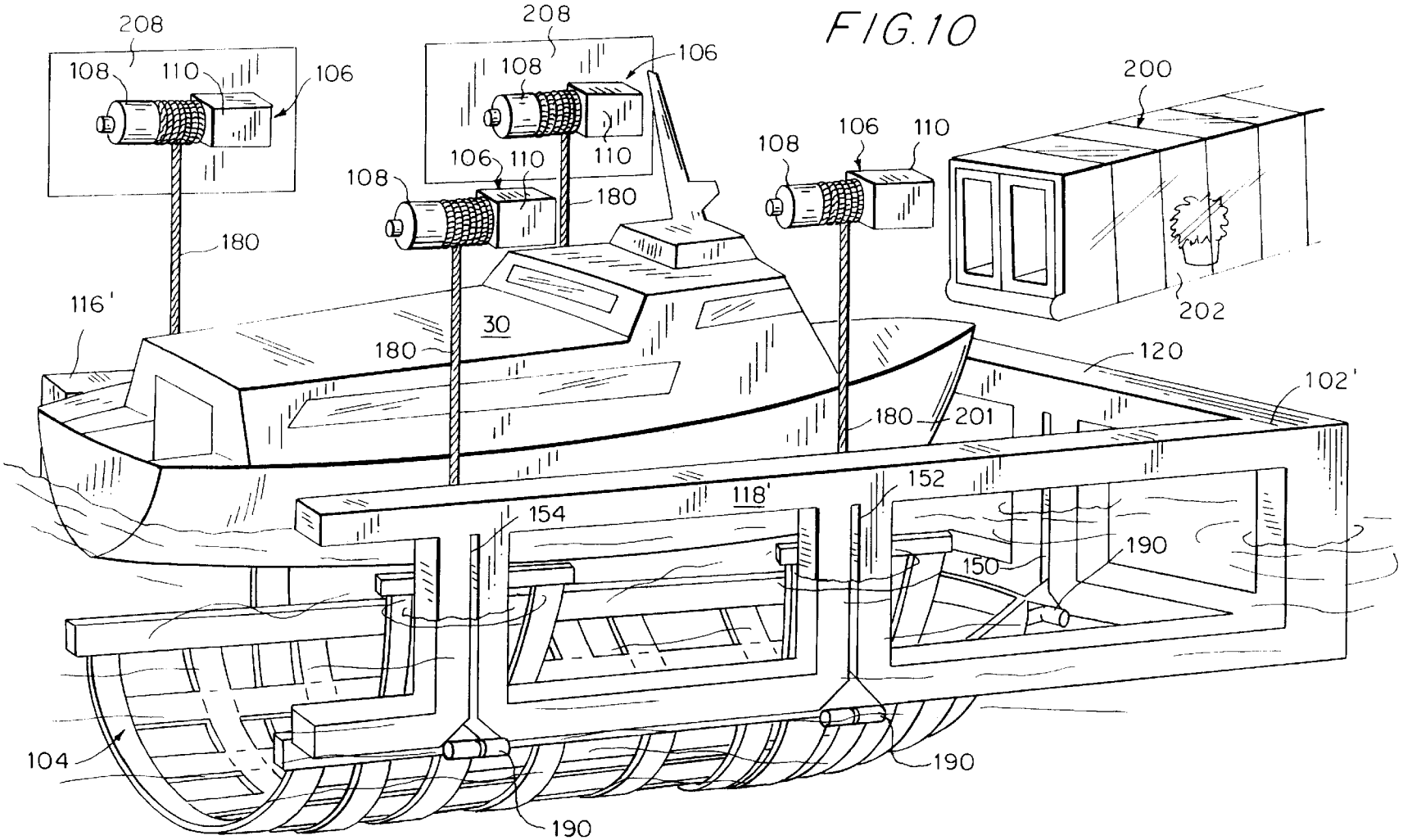
FIG. 10 is a perspective view of a second species of the second embodiment of the invention showing the cradle mounted on hoists fixed to the walls of a bay within a ship with the tender floating above the cradle.
Figure 11:
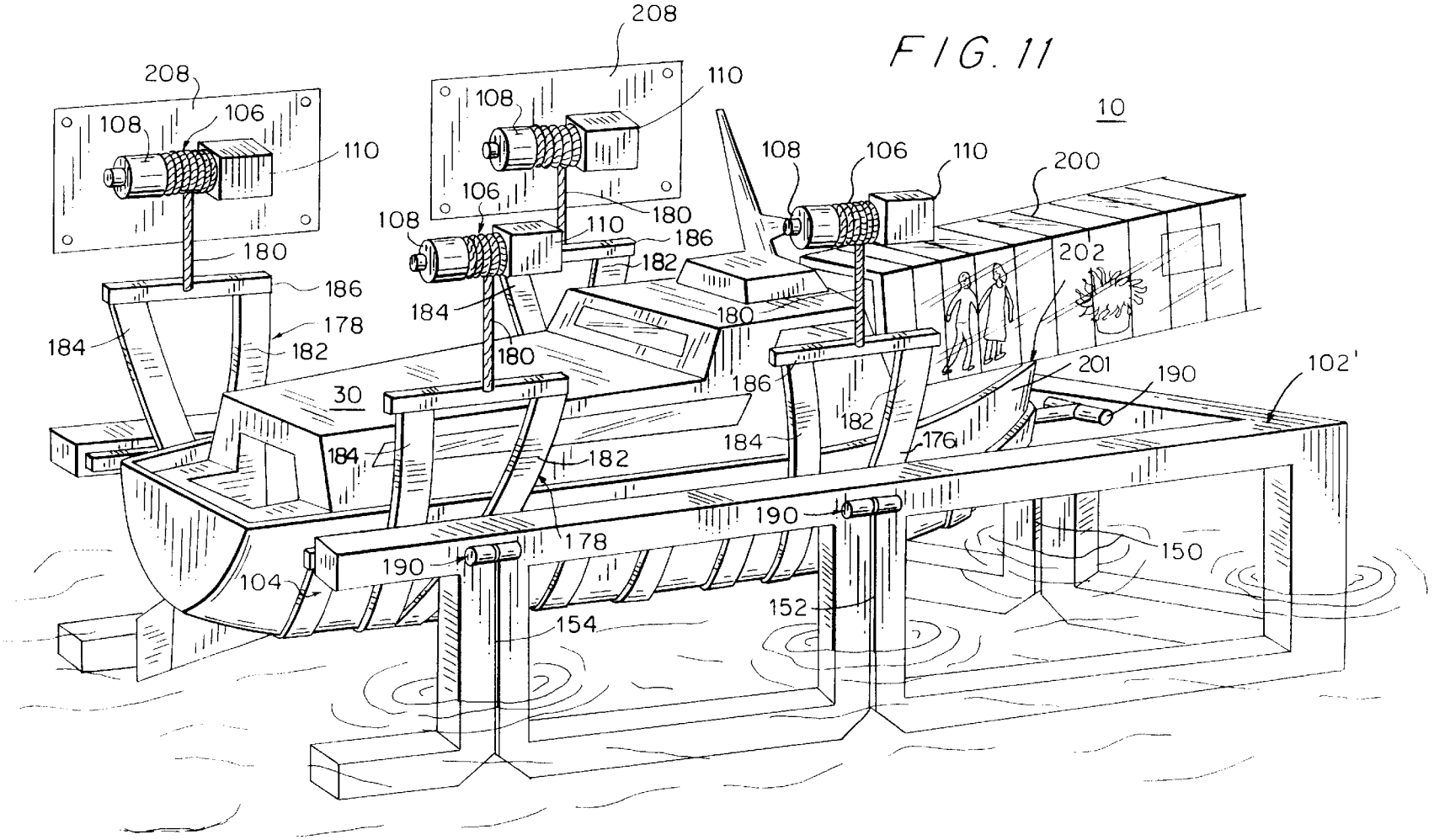
FIG. 11 is a perspective view showing the tender of FIG. 10 hoisted and stabilized within the bay for loading and unloading.
Figure 12:
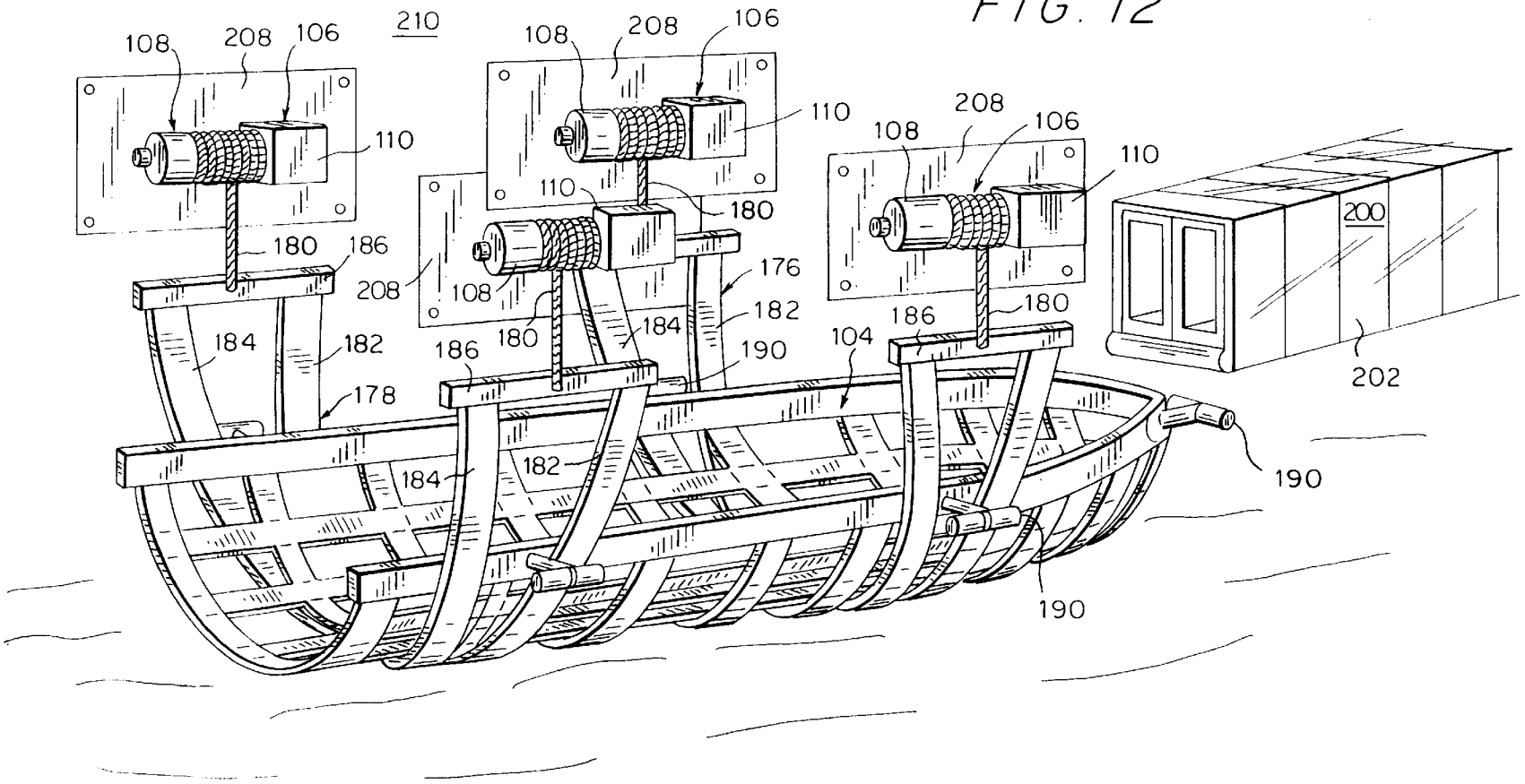
FIG. 12 is a perspective view similar to FIGS. 10 and 11, but showing the cradle without the frame and tender.

In accordance with a second species of the second embodiment of the invention, illustrated in isolation in FIG. 12, the cradle 104 is not suspended from supports 112 on the frame 102 of FIG. 9, but is rather suspended by mounting plates 208 fixed to side bulkheads 210 of the bay 20 which support the lift assemblies 106 comprised of motors 110 and windlasses 108. In FIGS. 10 and 11 the tender 30 is also shown suspended from mounting plates 208 instead of being suspended from supports 112 on the frame 102'. In order to stabilize the cradle 104 by using the T-shaped lugs 190 with the arrangement shown in FIGS. 10–12, it is necessary to rigidly fix the frame 102', similar to the frame 102, within the bay 20, which frame 102' has slots such as the slots 150–154 to receive the T-shaped lugs, but does not include supports 112.

Figure 13:
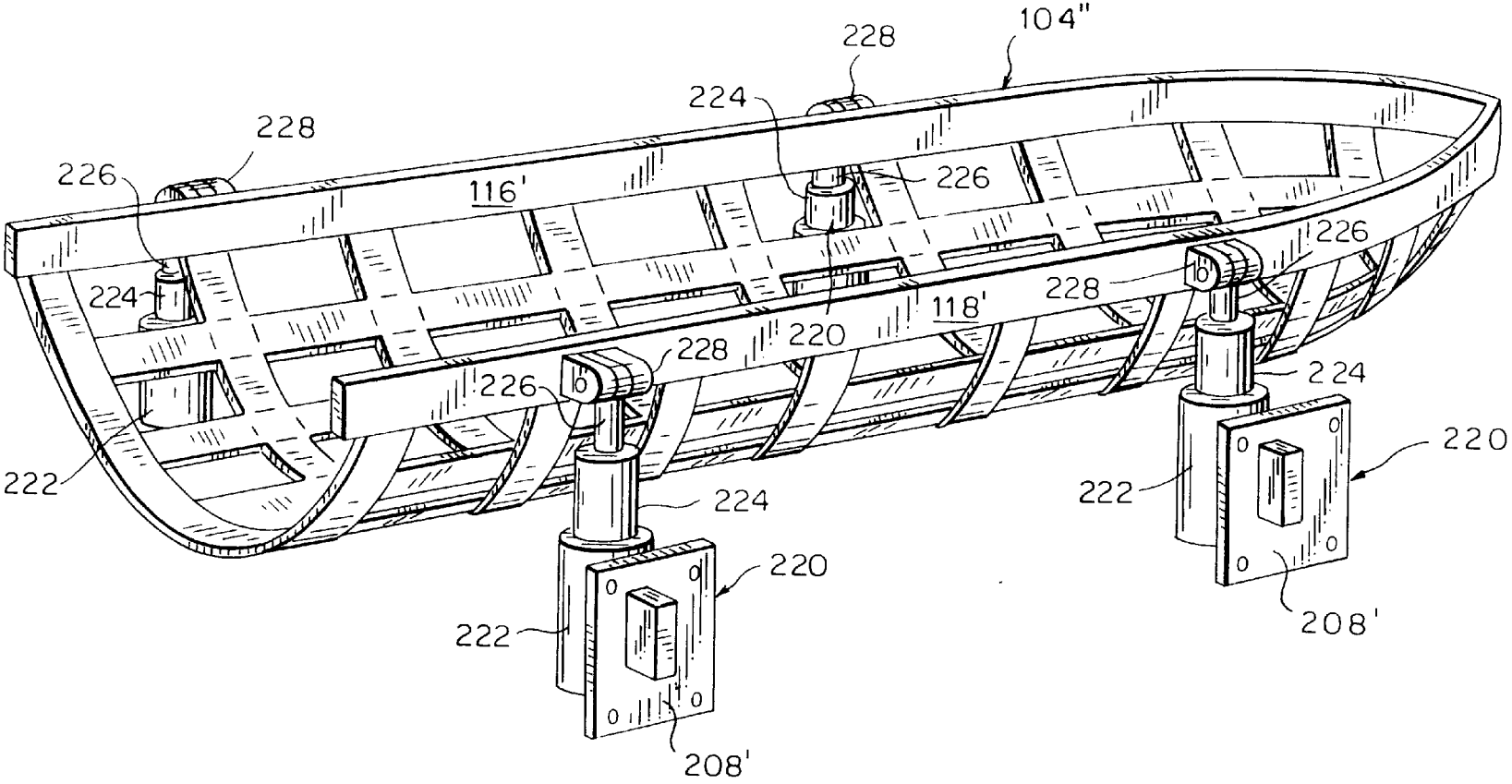
FIG. 13 is a perspective view of a third embodiment of a hoist assembly in accordance with the present invention, wherein hoisting is accomplished with hydraulic cylinders.

III) Third Detailed Embodiment (FIG. 13)

Referring now to FIG. 13 therein shown a third embodiment of the invention, wherein the cradle 104" is supported by four hydraulic lifts 220 in the side bulkheads 206 of the bay 20. Each hydraulic lift 220 includes a hydraulic cylinder 222 with an extension 224 that preferably extends above the water line. Pistons 226 project upwardly from the hydraulic cylinder 222 and engage with devises 228 projecting from the longitudinal beams 116 and 118' at the top of the cradle 104". The four hydraulic lifts 220 stabilize the tenders 30 with respect to the ship 10 upon lifting the tenders a sufficient height to negate buoyancy.

In an alterative arrangement of the third embodiment, the hydraulic lifts 220 are positioned above the cradle 104' and pistons 226 project downwardly to pull the cradle up to lift the cradle to a sufficient height so that the tender 30 does not float in the bay 20.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An arrangement for hoisting tenders from the sea into a ship having a bow and stern, the arrangement comprising:

a loading facility at the stern of the ship;

a hoist assembly fixed at the stern of the ship for lifting the tender until the tender no longer floats with respect to the ship;

a stabilizer arrangement for fixing the tender with respect to the ship after the tender has been lifted; and a gangway projectable from the ship to the tender after the tender has been lifted and stabilized for loading and unloading the tender.

2. The arrangement of claim 1, wherein the hoist assembly comprises a cradle for positioning beneath the tender and a lifting arrangement for lifting the cradle to at least a height where the tender is supported by the cradle rather than floating in the sea.

3. The arrangement of claim 2, wherein the facility includes a bay in the stern of the ship and wherein the hoist assembly is fixed within the bay.

4. The arrangement of claim 3, wherein the lifting arrangement comprises a plurality of windlasses having cables attached to the cradle for lifting the cradle as the windlasses wind up the cables.

5. The arrangement of claim 2, wherein the lifting arrangement comprises a plurality of hydraulic lifts for engaging the cradle to lift the cradle vertically within the bay.

6. The arrangement of claim 1, wherein the gangway comprises a telescoping passageway which projects to the tender for loading and unloading passengers from the tender.

7. The arrangement of claim 4, wherein the gangway comprises a telescoping passageway which projects to the tender for loading and unloading passengers from the tender.

8. The arrangement of claim 5, wherein the hoist assembly is fixed to the stern of the ship and extends from the stern of the ship and the gangway comprises a telescoping passageway which projects to the tender for loading and unloading passengers from the tender.

9. An arrangement for hoisting tenders from the sea into a ship having a bow and stern, the arrangement comprising:

a bay formed in the stern of the ship, the bay having an opening through the stern, the bay being defined by water-tight bulk heading and having a floor just above the level of the sea;

a hoist assembly disposed within the bay for lifting the tender until the tender is suspended by the ship, the hoist assembly being comprised of straps which have first and second ends connected to the carriage assembly at laterally displaced locations, the straps being submersible beneath the hull of the tender, and the hoist assembly further including lifters for raising the tender by applying tension to the straps; and a carriage assembly movable in and out of the bay for carrying the suspended tender into the bay in order to load and unload the tender while in the protection of the bay.

10. The arrangement of claim 9, wherein a net extends between the straps to form a cradle for lifting the tender.

11. The arrangement of claim 9, wherein the lifters for the strap are windlasses mounted on the carriage which rotate to accumulate portions of the straps to tension the straps so as to lift the tender into suspension from the ship.

12. The arrangement of claim 11, wherein the tender includes a loading and unloading area and wherein the bay includes a platform having a selected level above the floor of the bay to which the tender is lifted to align the loading and unloading area thereof with the platform.

13. The arrangement of claim 12 further including a latching mechanism proximate the platform for engaging the tender and fixing the tender with respect to the platform.

14. The arrangement of claim 12, wherein the carriage assembly is on rails fixed to the ship, wherein the rails extend beyond the stern of the ship to allow the carriage assembly to extend a selected distance beyond the stern of the ship for retrieving and releasing the tender.

15. The arrangement of claim 14, wherein the arrangement is part of a system, wherein the system includes a plurality of tenders for a single ship to provide a high speed shuttle system.

16. A method of shuttling passengers between a ship having a bow and a stern and another location by utilizing at least one tender, the method comprising:

cruising the ship at a relatively low speed to create a relatively flat sea to the stern of the ship;

approaching the stern of the ship through the relatively flat sea with the tender;

floating the tender over a cradle capable of lifting the tender from the relatively flat sea on which the tender floats;

lifting the tender by lifting the cradle to suspend the tender from the ship so that the tender no longer floats in the sea; and stabilizing the tender with respect to the ship to prevent relative motion between the tender and ship.

17. The method of claim 16, wherein the tender carries passengers and wherein the tender unloads and loads passengers while within the hull of the ship.

18. The method of claim 17, comprising shuttling a plurality of tenders between the ship and the location.

19. The method of claim 18, wherein the location is a shore location.

20. A method of returning to shore passengers from an offshore ship having a bow and a stern comprising:

loading the tender with passengers while the ship is underway and while the tender is docked with the ship;

undocking the tender with respect to the ship while the tender is loaded with the passengers and while the ship is underway;

carrying the passengers from said ship to shore on the tender, said tender having previously docked with said ship while said ship was underway by using an arrangement for hoisting at least one tender from the sea into the ship wherein the arrangement comprises:

a bay formed in the stern of the ship, the bay having an opening through the stern, being defined by water-tight bulk heading;

a passenger loading and unloading facility at the stern of the ship;

a hoist assembly disposed at the stern of the ship for lifting the tender until the tender is suspended from the ship instead of floating in the sea.

21. The method of claim 20, wherein there are a plurality of tenders shuttling between the ship and shore.

22. A method of returning ship passengers from an off-shore ship having a bow and a stern, comprising:

loading the tender with passengers while the ship is underway and while the tender is docked with the ship;

undocking the tender with respect to the ship while the tender is loaded with the passengers and while the ship is underway;

carrying the passengers from said ship to shore on a shuttle craft, said shuttle craft having previously docked with said ship according to a method of shuttling passengers between a ship and shore utilizing at least one tender, the method comprising:

cruising the ship at a relatively low speed to create a relatively flat sea to the stern of the ship;

approaching the stern of the ship through the relatively flat sea with the tender;

floating the tender over a cradle positioned at the stern of the ship;

lifting the tender by lifting the cradle to suspend the tender from the ship so that the tender no longer floats in the sea; and stabilizing the tender with respect to the ship to prevent relative movement between the tender and ship before transferring passengers between the ship and tender.

23. The method of claim 22 further including the steps of receiving the tender within a bay in the stern of the ship prior to transferring passengers between the ship and cradle.

* * * * *